United States Patent [19]

Coward

[11] 4,303,118

[45] Dec. 1, 1981

[54] APPARATUS FOR PRODUCING ALUMINUM-DEOXIDIZED CONTINUOUSLY CAST STEEL

[75] Inventor: Michael D. Coward, Murrells Inlet, S.C.

[73] Assignee: Georgetown Steel Corporation, Georgetown, S.C.

[21] Appl. No.: 60,270

[22] Filed: Jul. 25, 1979

[51] Int. Cl.[3] ..... B22D 11/04; B22D 11/10

[52] U.S. Cl. ..... 164/415; 164/266; 164/417; 164/437

[58] Field of Search ..... 164/415, 266, 270, 56, 164/57, 417, 437; 248/74 R

[56] References Cited

U.S. PATENT DOCUMENTS

| | | | |
|---|---|---|---|
| 1,303,345 | 5/1919 | McFeaters | 248/74 R X |
| 2,617,618 | 11/1952 | Blume | 248/74 R X |
| 3,459,537 | 8/1969 | Hornak | 164/56 X |
| 3,702,151 | 11/1972 | DeBlok et al. | 164/57 |
| 3,726,331 | 4/1973 | Bunting, Jr. | 164/57 |
| 3,766,961 | 10/1973 | Bunting, Jr. et al. | 164/415 |
| 3,771,584 | 11/1973 | Wojcik | 164/415 X |
| 4,084,799 | 4/1978 | Coward et al. | 164/415 X |
| 4,220,191 | 9/1980 | Fogarty | 164/57 |

*Primary Examiner*—Robert D. Baldwin
*Assistant Examiner*—J. Reed Batten, Jr.
*Attorney, Agent, or Firm*—Ralph H. Dougherty

[57] ABSTRACT

An aluminum wire feeder consisting of a flexible conduit and positioning tube are connected to a removable shroud by a tube holder. A feed mechanism provides a continuous source of aluminum wire for feeding the same to a continuous casting mold, only during shrouding conditions.

1 Claim, 3 Drawing Figures

APPARATUS FOR PRODUCING ALUMINUM-DEOXIDIZED CONTINUOUSLY CAST STEEL

BACKGROUND OF THE INVENTION

This invention relates to the continuous casting of aluminum deoxidized steels and more particularly to the feeding of the aluminum wire to a continuous casting mold without the formation of oxide inclusions.

It has long been known that the addition of aluminum to iron or steel will deoxidize the molten metal as was taught by U.S. Pat. No. 1,035,947, at least as early as 1912. Conventionally, aluminum can be added in the form of shot or granules and can be fed continuously by a screw feeder. An alternative feeding method is shown by Leupold in U.S. Pat. No. 3,331,680 in which aluminum wire is fed through a guide tube into a molten metal pouring stream. Injection of aluminum wire into steel during the casting procedure results in a deoxidized or aluminum killed steel. If aluminum is added to the molten metal in the ladle or the tundish, fine aluminate deposits form on the metering nozzles, eventually plugging the nozzles and shutting off flow of steel to the mold. Hence the need developed to add aluminum beneath the tundish. Leupold feeds his aluminum wire directly into the tundish stream which causes some turbulence and additional oxide entrainment. The prevention or reoxidation at the region of contact of the steel by the aluminum wire is of primary importance. If reoxidation at this location occurs there is a high probability that viscous manganesealumino-silicate inclusions will be formed, and entrapped on or immediately below the surface of the casting. Such inclusions can be major problems in subsequent processing of the steel casting. When aluminum wire is fed into the molten steel pouring stream in the invented system, the formation of harmful inclusions due to reoxidation is severely limited.

Aluminum has an extremely high affinity of oxygen. It will react with oxygen from air first, then with oxygen in steel. Thus it is important to exclude atmospheric oxygen from the environment adjacent to the steel stream. Experimentation has resulted in the development of an aluminum wire feeding system in conjunction with a continuous casting shroud which shrouds the molten metal during the pouring from the tundish into the mold.

A suitable feeder is available from Linde Division of Union Carbide.

SUMMARY OF THE INVENTION

This invention is a method and apparatus for continuous casting of aluminum deoxidized steels in which an aluminum wire feeder is connected to a removable shroud and directed toward the region of impact of the continuous casting stream or molten metal pouring stream with the molten metal in the mold. This invention is preferably used in conjunction with the shroud system taught by Coward et al in U.S. Pat. No. 4,084,799.

OBJECTS OF THE INVENTION

It is the principal object of this invention to provide a method for continuously deoxidizing continuously cast steel with aluminum.

It is also an object of this invention to provide apparatus for feeding wire to a continuous casting mold to any given location.

It is also an object of this invention to provide apparatus for feeding aluminum wire to a continuous casting mold only during shrouding of the molten metal stream.

It is another object of this invention to provide apparatus for feeding wire to molten metal in a mold which can be readily removable at any time casting is interrupted for any reason.

BRIEF DESCRIPTION OF THE DRAWINGS

The foregoing and other objects of this invention will become more readily apparent by perusal of the following detailed description and the appended drawings in which.

DETAILED DESCRIPTION

Figure 1:
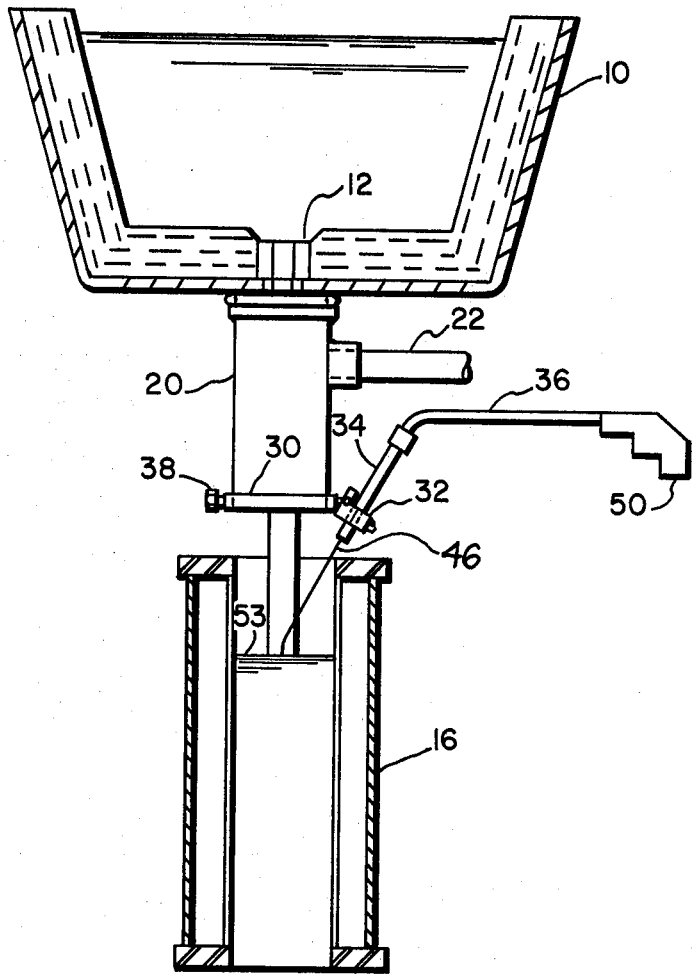
FIG. 1 is a partially sectioned elevational view of a continuous casting mold, tundish, shroud and a wire feeder in accordance with the invention.
Figure 2:
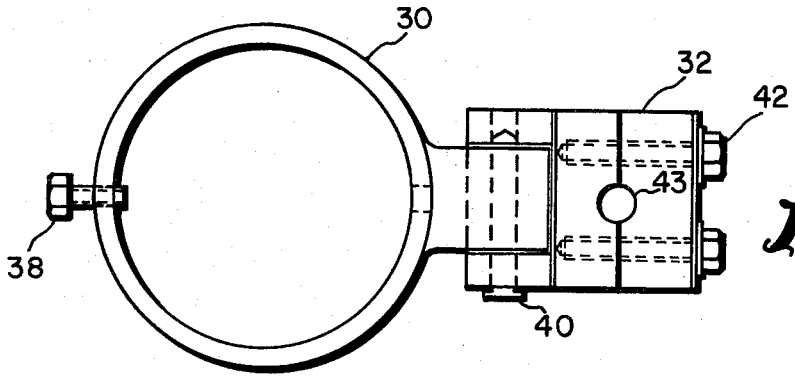
FIG. 2 is a plan view on a larger scale of the wire directing tube support and shroud connector ring.
Figure 3:
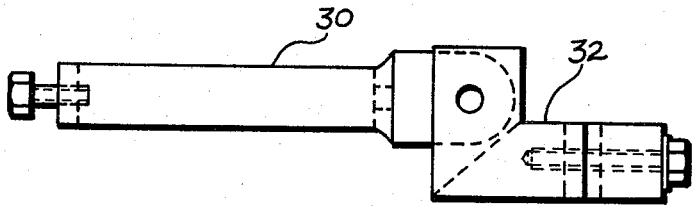
FIG. 3 is an elevational view of the apparatus of FIG. 2.

Referring now to FIG. 1, a pouring vessel such as tundish 10 is refractory lined and has a pouring nozzle 12 in its lower wall. A continuous casting mold 16 is spaced beneath the pouring vessel. A removable shroud tube 20 is supported independently by tube support arm 22 through which a shrouding gas may be injected into tube 20, i.e., arm 22 is tubular. At the bottom extremity of shroud tube 20 a removable wire feed tube assembly is affixed. This assembly consists of a support ring 30 and adjustable tube clamp 32, a wire directing feed tube 34 and a flexible conduit 36. The support ring 30 is removably connected to shroud tube 20 by a retaining screw 38. The adjustable tube clamp 32 is attached to support ring 30 by a pin and clevis arrangement and held in position by a retaining bolt 40 (see FIG. 2). The tube clamp 32 is a two-piece clamp having tightening screws 42 and a recess 43 for situating the wire feed tube 34. This feed tube is connected to a flexible conduit 36 through which aluminum wire 46 is passed by a feeding apparatus such as wire-feeding gun 50. Tube 34 must be made of a material which allows the soft aluminum wire to pass through it without any hang up. Suitable materials include copper and brass.

Since the clevis portion of support ring 30 is directly opposite the retaining screw 38 the line of feed from wire direction tube 34 must intersect the axis of the shroud tube 20. A shroud tube is always positioned with its axis coincident with the axis of the pouring stream. The tightening of bolt 40 on the clevis arrangement will hold the wire directing tube in proper orientation. The preferred angle of incidence results in the wire impinging on the pouring stream within the mold a short distance above the meniscus. By proper adjustment of the angle of feed tube 34, the wire may be caused to impinge on the pouring stream at any location between the bottom of the shroud tube and the level of the liquid 53 in the mold.

As a specific example of the operation of this invention, 3/32 inch diameter aluminum wire was fed through the wire feeding apparatus at both slow and maximum speeds under good shrouding conditions without incurring any casting problems. Numerous transverse slices were cut from the cast billets and analyzed for aluminum content and distribution. The tests indicate that the aluminum distribution across the cross section of the billet has no significant variation. Etch tests were made to determine whether any large slag pockets were present at or near the surface of the billet. The results showed that the aluminum recovery is substantially 100% and that the aluminum distribution across the billet is relatively uniform. There were very few inclusions and no slag pockets in the etch tests.

The directional wire feed apparatus can be employed with any presently known shrouding device which completely excludes air from the shrouding device. In fact, in the case where a mold top is completely covered, access can be made in the mold cover for this wire feed apparatus while retaining its adjustable feature.

It can readily be seen from the foregoing that I have invented an apparatus for feeding aluminum wire to a continuous casting mold under shrouding conditions which will cease to feed aluminum to the mold when the shroud is removed from the operative position. This insures that only prime quality steel is produced because when the shroud is removed, the casting does not contain aluminum and must be identified as non-aluminum-killed steel.

What is claimed is:

1. In the continuous casting of steel from a bottom-pour vessel into a vertically oscillatible continuous casting mold through a removable shroud, said vessel having a pouring nozzle in its bottom wall, said shroud being movable into an active position around said nozzle and in sealable relation with said vessel, and into a stand-by position remote from said nozzle, the improvement comprising apparatus detachably connected to said shroud for feeding wire to said mold during the shrouding of the pouring stream, said apparatus comprising:

(a) fastening means carried by and at the lower edge of said shroud for holding a wire directing tube, said fastening means consisting essentially of:
  (i) an adjustable tube clamp for adjusting the direction and the angle of inclination of said tube,
  (ii) a support ring removably connected to said shroud and carrying a protrusion adapted for engagement with said tube clamp, and
  (iii) means for holding said tube clamp in a desired orientation;

(b) a wire detecting tube positioned in said fastening means;

(c) a flexible conduit attached to the end of said tube remote from said mold; and (d) a wire feeding mechanism communicating with said flexible conduit for feeding wire through said conduit into said mold.

* * * * *